US007021392B2

(12) United States Patent
Bentzien et al.

(10) Patent No.: US 7,021,392 B2
(45) Date of Patent: Apr. 4, 2006

(54) BODY WITH COUPLINGS

(75) Inventors: Dean L. Bentzien, Brookfield, WI (US); Guido Brusa, Brookfield, WI (US)

(73) Assignee: Allora International, LLC, Sussex, WI (US)

( * ) Notice: Subject to any disclaimer, the term of this patent is extended or adjusted under 35 U.S.C. 154(b) by 126 days.

(21) Appl. No.: 10/831,746

(22) Filed: Apr. 23, 2004

(65) Prior Publication Data

US 2005/0236166 A1 Oct. 27, 2005

(51) Int. Cl.
*A62C 37/08* (2006.01)

(52) U.S. Cl. ..... 169/37; 239/600; 239/225.1; 239/259; 239/209; 285/305

(58) Field of Classification Search ..... 169/37–41; 239/305, 214, 225.1, 259, 251, 273, 119, 239/722, 209, 600; 285/305, 276
See application file for complete search history.

(56) References Cited

U.S. PATENT DOCUMENTS 1,659,470 A * 2/1928 Owen et al. ..... 239/547
5,836,397 A * 11/1998 Craig et al. ..... 169/5
6,302,445 B1 * 10/2001 Kugele et al. ..... 285/5
6,340,059 B1 1/2002 Bethea

FOREIGN PATENT DOCUMENTS

DE 20207259 U1 9/2002
WO WO 200046532 A1 8/2000

OTHER PUBLICATIONS

Brochure: FASTEC—The Revolutionary Connection, Quick and Easy . . . As Moving a Finger. 8 pages, date unknown.

* cited by examiner

*Primary Examiner*—Dinh Q. Nguyen
(74) *Attorney, Agent, or Firm*—Ryan Kromholz & Manion, S.C.

(57) ABSTRACT

A sprinkler head assembly having a sprinkler head with a through bore is coupled to a coupling member having a bore in fluid communication with said through bore of said sprinkler head. One of said sprinkler head and coupling member fits within the other. A groove is formed on the inner member for receiving a portion of a set pin slidingly engaged within the outer member. A seal between the inner and outer member provides a fluid-tight connection.

12 Claims, 5 Drawing Sheets

BODY WITH COUPLINGS

BACKGROUND OF THE INVENTION

The present invention relates to sprinkler systems, and more specifically, to coupling arrangements for sprinkler heads.

One of the main problems with sprinkler systems and plumbing, in general, is providing an efficient and easy to use connection system for specifically joining a sprinkler head to the plumbing of the sprinkler system, with installation speed being minimized. Known couplings and connectors require specific alignment and sealing of threads when joining a sprinkler head to a pipe section. For example, the threads must be wrapped in Teflon® tape or coated with a threaded joint compound prior to sealing the sprinkler head to the pipe section. Especially when replacing a sprinkler head in an already existing and installed sprinkler system, achieving a leak-proof system can be difficult. Improvements have been made over well-known processes, such as sweating and welding of the pipe sections together, but these improvements have not been specifically directed towards joining of the sprinkler head to the sprinkler system. For instance, new improvements allow for crimping of two sections of pipe together in an airtight and watertight fashion. Likewise, connections have been developed to press fit sections of pipe together using mating pipe structures. Still, these advancements have not focused specifically on providing an easy to use connection system for a sprinkler head. Connector means specifically directed toward sprinkler heads have not advanced in the art. The majority of sprinkler heads are threaded into mating coupling sections within the pipe sections.

Another problem when installing sprinkler heads into sprinkler systems is properly aligning the sprinkler heads, especially when installing several sprinkler heads in a long piping arrangement. Threaded designs require the arduous task of aligning the threads when inserting the sprinkler head and then realigning the sprinkler head if the head is not properly orientated with other sprinkler heads in the system. The process may be very time consuming and taxing on the installer.

Some prior art has addressed simplified arrangements for connecting sprinkler heads to piping assemblies. For instance, Bethea, U.S. Pat. No. 6,340,059, contemplates a threadless sprinkler head assembly for attaching a sprinkler head to a pipe conduit. While the invention alleviates problems of threads that must be sealed for a watertight fit and sprinkler heads that may be hard to insert or remove due to corrosion, the assembly is not necessarily the quickest to install. A bracket that surrounds the pipe conduit holds the sprinkler head firmly in place. However, if the pipe conduit does not have sufficient clearance with respect to nearby walls or ceilings, the sprinkler head cannot be easily installed. Likewise, when removing the sprinkler head, the bracket must also be at least partially removed, and alignment of the sprinkler head is not necessarily easier than previous arrangements.

Because the sprinkler head should form a watertight seal with the piping assembly to which it is connected, sprinkler heads have either been soldered within the piping assembly, or threaded within the assembly. While these adaptors provide for the necessary watertight fit, they can cause problems when trying to remove or replace the sprinkler head. For instance, the threads on a threaded sprinkler head may corrode over time, which may make it difficult to remove the sprinkler head. A wrench may be necessary to remove the sprinkler head, and the removal process may strip the threads. Sprinkler heads have not utilized couplings or fittings that are quickly and easily insertable and removable, quickly and easily aligned with other sprinkler heads in a sprinkler system, and provide a watertight fit.

SUMMARY OF THE INVENTION

The present invention provides a simple coupling system for connecting a sprinkler head to a pipe or piping system. A sprinkler head assembly is provided having a sprinkler head having a through bore that is coupled or joined to a coupling member having a bore in axial alignment with the through bore of the sprinkler head. The assembly further has coupling means for securing the sprinkler head to the coupling member. The coupling means comprises adjoining male and female mating surfaces. The male mating surface includes a circumferentially grooved portion. The coupling means further comprises a retractable set pin having a shank portion located transversely of the female mating surface and residing in the grooved portion of the male mating surface when fully depressed.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
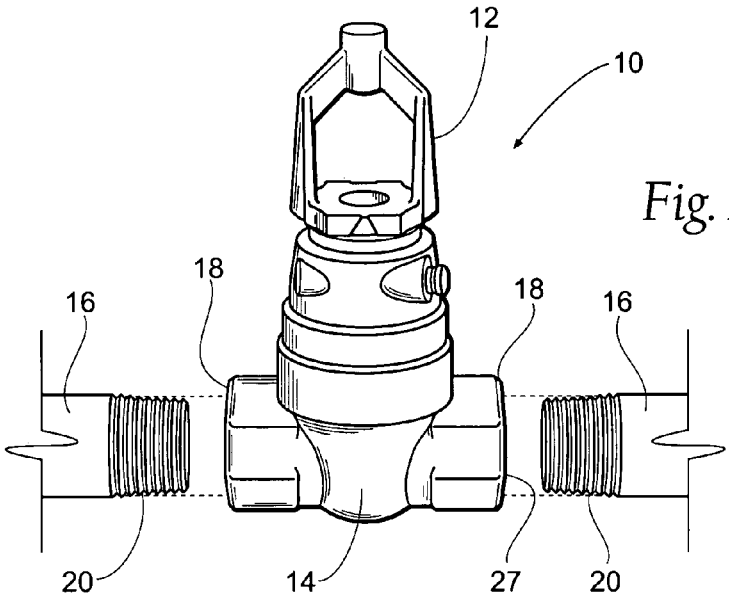
FIGS. 1–5 are perspective views depicting sprinkler head assemblies in accordance with the present invention utilizing various piping connectors.
Figure 2:
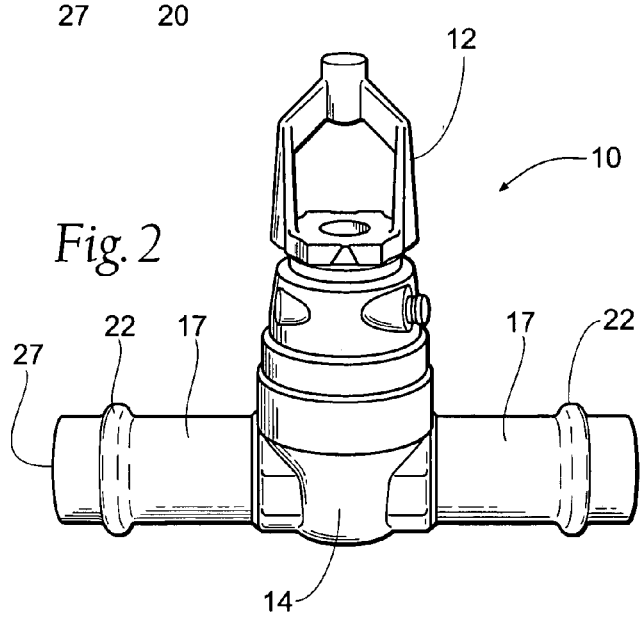

FIGS. 1–5, inclusive, show a sprinkler head assembly 10 according to the present invention. The assembly 10 generally comprises a sprinkler head 12 and a coupling member 14 for receiving the sprinkler head 12. The sprinkler head 12 is only representative of sprinkler heads that may be utilized in accordance with the present invention, and it should be understood that the present invention should not be limited to any specific sprinkler head or sprinkler head design. The sprinkler head assembly 10 further includes pipe sections 16 connected to ends 18 of the coupling member 14. The pipe sections 16 may be connected to the coupling member 14 in a variety of ways. For instance, FIG. 1 depicts the pipe sections 16 having threaded pipe ends 20 that will be screwed into internal mating threads (not shown) in the ends 18 of the coupling member 14. FIG. 2 shows an alternate embodiment wherein couplings 17 have a raised section 22 housing a seal so that the pipe sections 16 may be crimpably connected to the coupling member 14.

Figure 3:
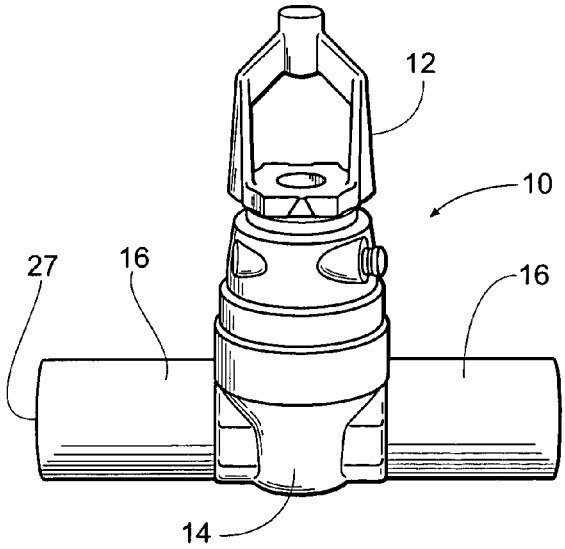
Figure 4:
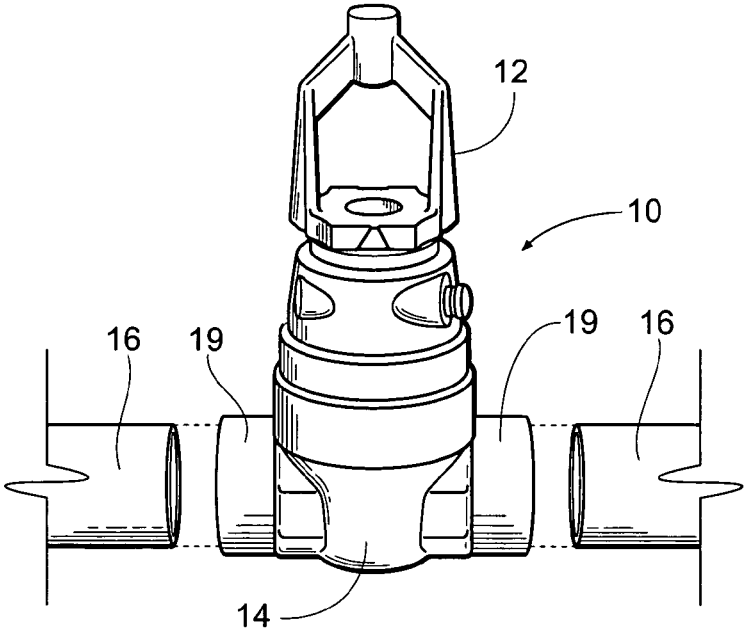

FIGS. 3 and 4 show another embodiment wherein the pipe sections 16 being soldered or "sweated" together with the coupling member 14. The pipe sections 16 will form male press fittings that will be inserted into a female stub 19. The pipe sections 16 would be sweated together with the stub 19 in a watertight fashion.

Figure 5:
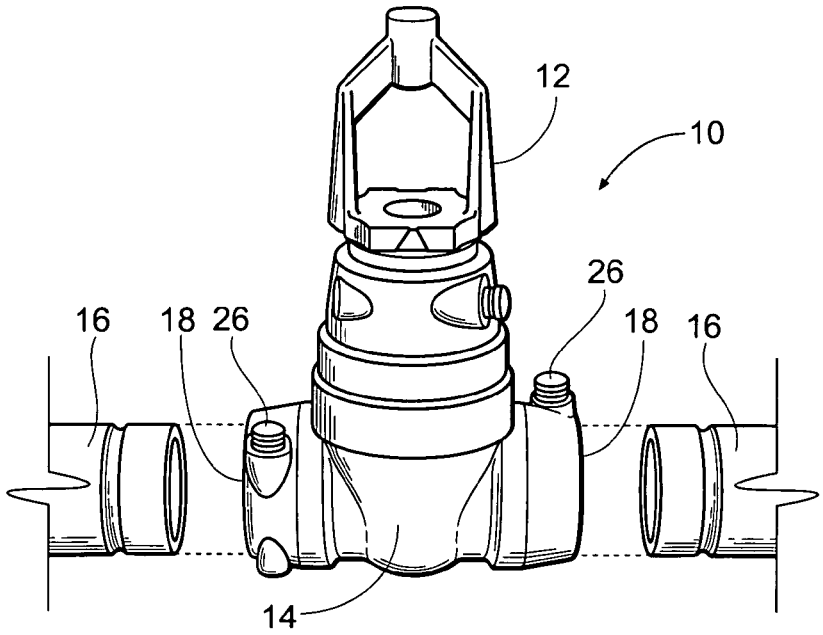

FIG. 5 depicts yet another embodiment including the use of a set pin 26 to connect the pipe sections 16 to the coupling member 14. Provided that a watertight through bore 27 is formed between the coupling member 14 and the pipe sections 16, any suitable connection means for the pipe sections 16 and the coupling member 14 will fall within the scope of the invention. FIGS. 1–5 are merely exemplary of possible connection means and should not be considered as limiting on the scope of the invention. Nor should it be considered necessary to have the pipe sections 16 located on both sides of the coupling member 14. Either of the pipe sections 16 may be replaced with a plug, valve, or other device, or the coupling member 14 could be designed with a single end 18 for connection to a single pipe section 16 and still fall within the scope of the invention. It may also be possible that the sprinkler head 12 would be replaced with a plug, for instance when the sprinkler head assembly 10 is the last assembly in an overall piping system, and it is not necessary or required for the piping system.

Figure 6:
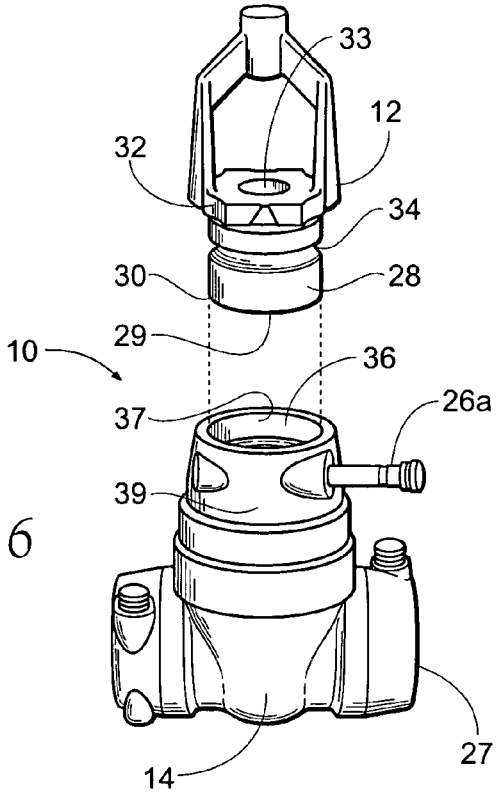
FIG. 6 is an exploded view depicting the sprinkler head assembly shown in FIG. 5.

FIG. 6 depicts an exploded view of the sprinkler head assembly 10. The sprinkler head 12 comprises a sprinkler body 28 with a first end 30 and a second end 32. The sprinkler head 12 has a through bore 33 for fluid to pass through the sprinkler head assembly 10 when in use. The sprinkler body 28 further comprises a skirt 29 having a circumferentially grooved portion 34. The grooved portion 34 may be designed so that it does not completely surround the sprinkler body 28, but for ease of installment, a circumferential groove 34 is preferred. If the groove 34 surrounds the sprinkler body 28, it will not be necessary for precise alignment when inserting the sprinkler body 28 in to the coupling member 14. The sprinkler body skirt 29 forms a male mating surface that will be inserted into an opening 36 having an inner wall 37, which forms a female mating surface, within the coupling member 14. An outer skirt 39 is formed about the upper most portion of the coupling member 14. The opening 36 provides a bore that is preferably axially aligned with the sprinkler body 28 and preferably axially aligned with the through bore 33 of the sprinkler head 12. The first end 30 of the sprinkler body 28 will be inserted into the opening 36, which intersects and is in fluid communication with the through bore 27.

Still referring to FIG. 6, the sprinkler body 28 will fittingly be secured into the opening 36 so that the sprinkler body 28 and the opening 36 form a watertight connection. The skirt 29 is sized to fit within the opening 36. Once inserted into the opening 36, a set pin 26*a*, similar to the set pin 26 shown in FIG. 4 to join the pipe sections 16 to the coupling member 14, will fixedly hold the sprinkler body skirt 29 in the opening 36.

Figure 7:
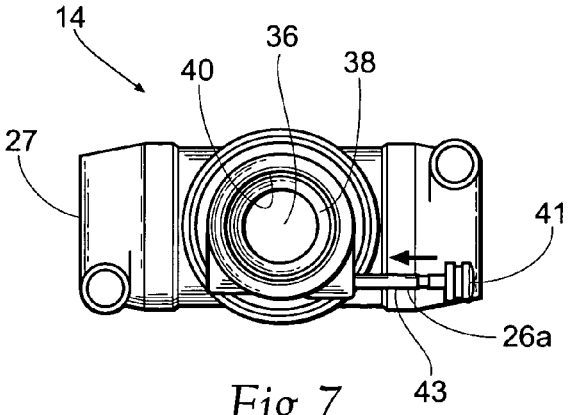
FIG. 7 is a top plan view depicting a coupling member in accordance with the present invention.

FIG. 7 is a top plan of the coupling member 14. As previously stated, the opening 36 is in fluid communication with the through bore 27 transversely located in the body of the coupling member 14. A flange 38 is provided within the opening 36 for the first end 30 of the sprinkler body 28 to abut when inserted into the opening 36 (see FIG. 9). In the side of the opening 36 above the flange 38 sits a seal 40, conventionally referred to as an o-ring in a preferred embodiment, that provides for a secure fit between the opening 36 and the sprinkler head 12. The seal 40 could be in any form that would provide a watertight fit when the sprinkler head 12 is mated with the coupling member 14.

Figure 8:
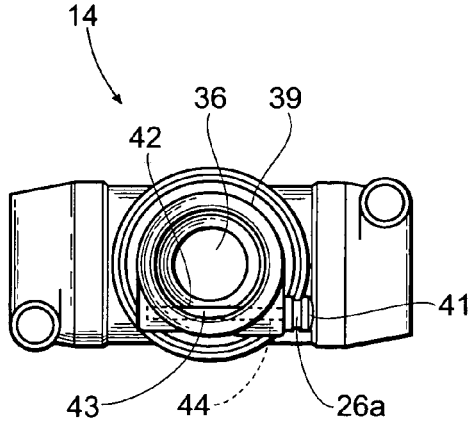
FIG. 8 is a top plan view, similar to FIG. 7 but showing the set pin in broken lines after being fully depressed.

Still referring to FIG. 7, the set pin 26*a* is shown extended outwardly of the opening 36. The set pin 26*a* has a head portion 41 and a shank 43. The set pin 26*a* is preferably cylindrical and formed from a hard, resilient metal or similar material. The set pin 26*a* provides a simple and efficient way to connect the sprinkler head 12 to the coupling member 14. The shank 43 is designed to easily slide into and intersect the opening 36 (see FIG. 8) and is movable between a first position (FIG. 7) and a second position (FIG. 8). Instead of previous designs that may require threads, soldering, or clamps to join the head 12 to the coupling member 14, the set pin 26*a* will secure the head 12 in place, as will be discussed with respect to the remaining figures.

FIG. 8 is similar to FIG. 7 except the set pin 26*a* is shown inserted into the opening 36. The head portion 41 provides an area for a person to push the shank 43 into the female mating surface and the opening 36. The set pin 26*a* intersects the opening 36 to form a protrusion 42 that will interact with the grooved portion 34 of the skirt 29 (see FIG. 9), which allows the sprinkler head 12 to be retained within in the opening 36. The set pin 26*a* is designed so that it easily slides in and out of a channel 44 formed in the outer skirt 39. Where the channel 44 intersects the inner wall 37 of the opening 36, there is no barrier between the channel 44 and the opening 36, thereby allowing the shank 43 of the set pin 26*a* to form the protrusion 42 previously discussed. The shank 43 is preferably cylindrical, as is the channel 44 that receives the shank 43. However, the shapes of both the shank 43 and the channel 44 may be of any shape that allows the set pin 26*a* to form the protrusion 42 within the opening 36.

Figure 9:
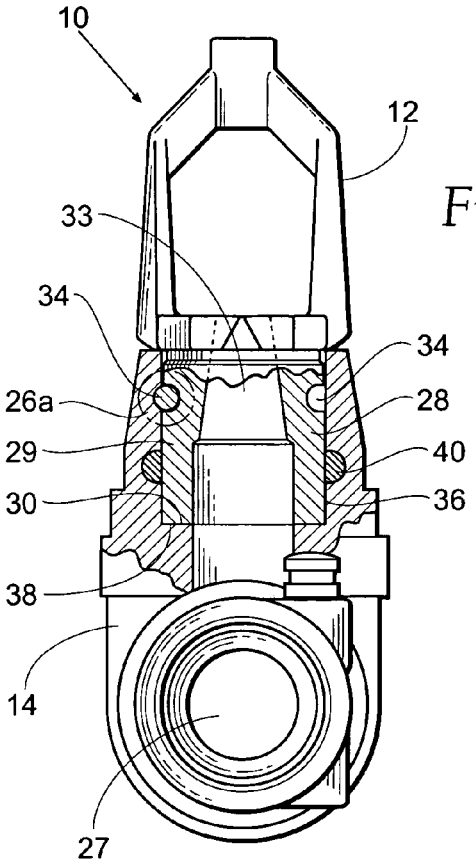
FIG. 9 is a partially cut-away view of the sprinkler head assembly in accordance with the present invention.

FIG. 9 is a partially cut-away side view of the sprinkler head assembly 10. The sprinkler head 12 is shown situated within the opening 36 in the coupling member 14. The first end 30 of the sprinkler body 28 abuts the flange 38, with the seal 40 forming a watertight connection. The through bore 33 of the sprinkler head 12 is in fluid connection with the through bore 27 of the coupling member 14 (see FIG. 10). The set pin 26*a* will nestle within the grooved portion 34 when the set pin 26*a* is slid into the opening 36, thereby securing the sprinkler head 12 in mating fashion to the coupling member 14.

Figure 10:
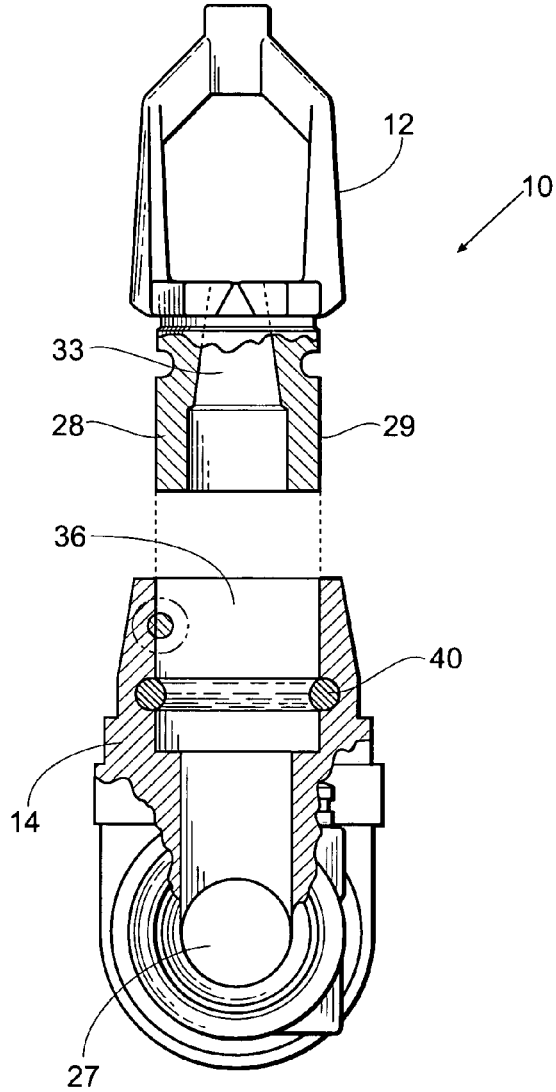
FIG. 10 is an exploded partially cut-away view of the sprinkler head in accordance with the present invention.

FIG. 10 is an exploded view of the assembly 10 shown in FIG. 9. The sprinkler head skirt 29 is sized so that it will mate with the opening 36. However, the body 28 and the coupling member 14 are machined out of a material that will allow the body 28 to easily slide in and out of the opening 36, as shown. The design provides for easy addition and removal of the sprinkler head 12, when necessary. The seal 40 extends into the opening 36 to provide a watertight seal when the sprinkler head is inserted therein. As previously stated, the opening 36 will intersect the through bore 27, providing a continuous water passageway to the through bore 33.

Figure 11:
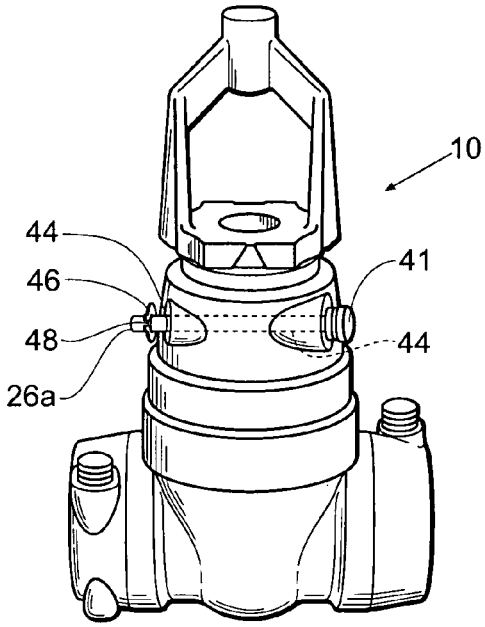
FIG. 11 is a perspective view of a sprinkler head assembly in accordance with the present invention utilizing secondary fastening means to secure the sprinkler head within the sprinkler head assembly.

FIG. 11 depicts the assembly 10 with a further embodiment of the set pin 26*a*. Previously, the channel 44 had a closed end (see FIG. 6). In FIG. 11, the channel 44 is now a through channel, which allows a pin or clasp 46, represented here as a c-clip 46, to be inserted into a groove 48 located in the end of the set pin 26*a*. This allows the pin 26*a* to be locked in place and prevents the accidental removal of the pin 26*a*, especially when the sprinkler system is pressurized. The pin 46 and the groove 48 may take on various forms, such as a nut and bolt, a snap-on washer, a cotter pin and a corresponding hole, or any other similar devices.

Figure 12:
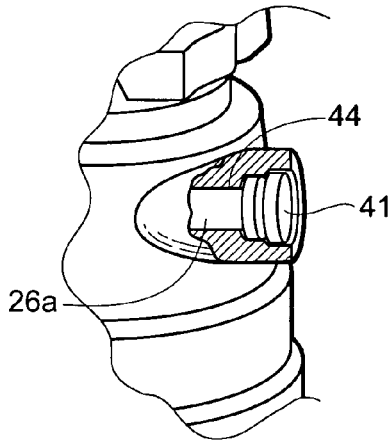
FIG. 12 is a close-up partially cut-away sectional view of a further arrangement of securing means employed in a sprinkler head assembly according to the present invention.

FIG. 12 shows a close-up partially cut away view of an embodiment of head portion 41 of the pin 26*a*. The end of the channel 44 is now extended past the head portion 41 (compare with FIG. 11). The arrangement provides for an additional safety feature so that the pin 26*a* will not be inadvertently pulled out after installation. In the arrangement shown in FIG. 12, it may be necessary to used pliers or another tool (not shown) to remove the pin 26*a*.

Figure 13:
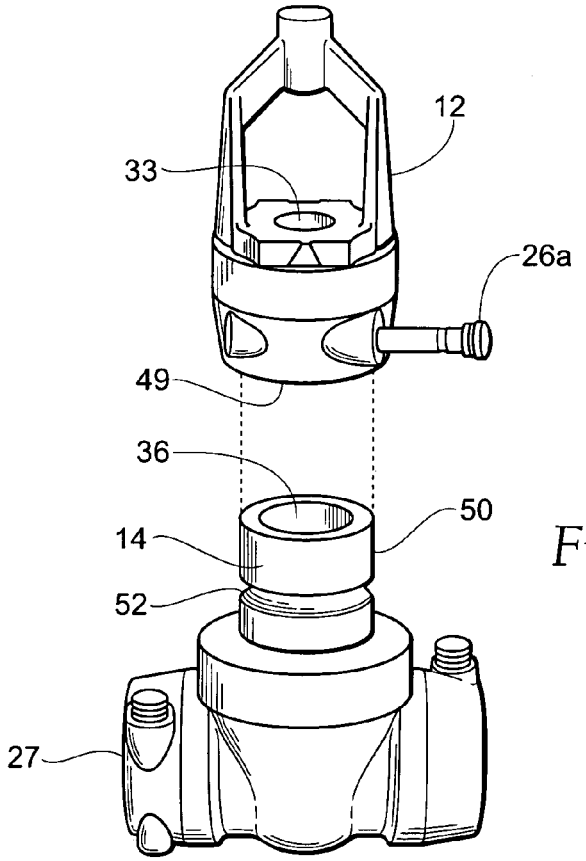
FIG. 13 shows an exploded view of an alternate embodiment of the present invention.

FIG. 13 shows an exploded view of an alternate embodiment of the present invention. This arrangement allows the sprinkler head 12 to mate on an outer skirt 50 of the coupling member 14, as opposed to within the opening 36. The sprinkler head 12 has an inner surface 49, which is sized to fit over the outer skirt 50 of the coupling member 14 to form a watertight connection. The set pin 26*a* is located on the sprinkler head 12, with a grooved portion 52 located on the outer skirt 50 of the coupling member 14. The grooved portion 52 performs the same function as the grooved portion 34, described previously with respect to FIG. 6. The set pin 26*a* is movable between a first position and a second position, as described with respect to FIGS. 7 and 8. The through bore 33 of the sprinkler head 12 and the bore formed by the opening 36 are still in fluid communication with the through bore 27 of the coupling member 14.

The present invention is advantageous over other configurations used for sprinkler heads. The seal formed between the sprinkler head 12 and the coupling member 14 is watertight without welding, crimping, or the like, and the sprinkler head 12 may be quickly inserted into the coupling member 14. The sprinkler head 12 may also be easily removed when necessary without the need for tools, unless specifically designed to utilize a tool to move the set pin 26*a* outwardly from the channel 44, as described with respect to FIG. 12. The sprinkler head 12 is not threaded, which allows easier alignment of the sprinkler head and the coupling member, and also minimizes potential corrosion of the sprinkler head 12, which would causes a more difficult removal process of the sprinkler head 12. The set pin 26*a* sufficiently retains the sprinkler head 12 as currently described without needing extra connectors or securing means and provides an assembly that can be removed and replaced as necessary.

Also, the present invention is advantageous over previous sprinkler head designs in that time spent aligning several sprinkler heads within a sprinkler system is minimized. Since there threads are not located on the coupling member or the sprinkler head, the sprinkler head may be inserted quickly and easily. Sprinkler heads inserted after the initial sprinkler head can be quickly aligned with the first sprinkler head and easily inserted into the corresponding coupling member. If the sprinkler head is not aligned properly, it may be easily removed from the coupling member and realigned, without threading and unthreading the sprinkler head.

The present invention may be utilized within a wide range of piping materials, such as steel, copper, or PVC pipe. For instance, PVC pipes currently used for sprinkler systems may be internally fitted with the sprinkler fittings as discussed above.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A sprinkler head assembly comprising:

a sprinkler head having a through bore;

a coupling member having a bore in fluid communication with said through bore of said sprinkler head, said coupling member further having an inner surface;

said sprinkler head having a skirt and including a groove formed in said skirt;

said skirt sized to fit within said bore; and a set pin located transversely of said bore and engageable with said groove when said sprinkler head skirt is located within said bore.

2. The sprinkler head assembly according to claim 1, wherein said set pin is movable between a first and a second position.

3. The sprinkler head assembly according to claim 1 further comprising a seal for sealing said sprinkler head and said coupling member, said seal located in said inner surface of said coupling member.

4. The sprinkler head assembly according to claim 3 wherein said seal comprises a gasket located in said inner surface of said coupling member.

5. The sprinkler head assembly according to claim 1 wherein said coupling member further includes a through bore intersecting said bore of said coupling member.

6. The sprinkler head assembly according to claim 5 wherein said coupling member further includes means for joining said coupling member to at least one pipe section.

7. A sprinkle head assembly comprising:

a sprinkler head having a through bore and an inner surface;

a coupling member having a bore fluidly engaged with said through bore of said sprinkler head, said coupling member having an outer skirt and including a groove formed in said skirt, said outer skirt sized to fit within said sprinkler head through bore; and a set pin located transversely of said sprinkler head through bore and engageable with said groove when said coupling member skirt is located within said sprinkler head through bore.

8. The sprinkler head assembly according to claim 7, wherein said set pin is movable between a first and a second position.

9. The sprinkler head assembly according to claim 7 further comprising a seal for sealing said sprinkler head and said coupling member, said seal located in said inner surface of said sprinkler head.

10. The sprinkler head assembly according to claim 9 wherein said seal comprises a gasket located in said inner surface of said sprinkler head.

11. The sprinkler head assembly according to claim 7 wherein said coupling member further includes a through bore intersecting said bore of said coupling member.

12. The sprinkler head assembly according to claim 11 wherein said coupling member further includes means for joining said coupling member to at least one pipe section.

* * * * *